US008281628B2

(12) United States Patent
Widén

(10) Patent No.: US 8,281,628 B2
(45) Date of Patent: Oct. 9, 2012

(54) PROFILE KEY WITH LOCAL RECESS

(75) Inventor: Bo Widén, Torshälla (SE)

(73) Assignee: Winloc AG, Zug Schweiz (CH)

( * ) Notice: Subject to any disclaimer, the term of this patent is extended or adjusted under 35 U.S.C. 154(b) by 32 days.

(21) Appl. No.: 12/388,027

(22) Filed: Feb. 18, 2009

(65) Prior Publication Data

US 2010/0206026 A1 Aug. 19, 2010

(51) Int. Cl.
*E05B 19/06* (2006.01)
*E05B 27/00* (2006.01)

(52) U.S. Cl. ..... 70/409; 70/358; 70/406; 70/493; 70/495

(58) Field of Classification Search ..... 70/358, 70/405–407, 409, 492–495
See application file for complete search history.

(56) References Cited

U.S. PATENT DOCUMENTS 4,356,713 A * 11/1982 Widen ..... 70/495
4,393,673 A * 7/1983 Widen ..... 70/358
D274,302 S * 6/1984 Widen ..... D8/347
4,453,432 A * 6/1984 Widen ..... 76/110
4,756,177 A * 7/1988 Widen ..... 70/493
4,815,307 A * 3/1989 Widen ..... 70/493
5,067,335 A * 11/1991 Widen ..... 70/495
5,421,179 A * 6/1995 Bergstrom ..... 70/369
5,438,857 A * 8/1995 Kleinhaeny ..... 70/493
5,582,050 A * 12/1996 Haggstrom ..... 70/495
5,640,865 A * 6/1997 Widen ..... 70/495
5,715,717 A * 2/1998 Widen ..... 70/493
5,809,816 A * 9/1998 Widen ..... 70/493
5,845,525 A * 12/1998 Widen ..... 70/493
5,964,112 A * 10/1999 Stefanescu ..... 70/493
6,134,929 A * 10/2000 Widen ..... 70/493
6,851,292 B2 * 2/2005 Kruhn ..... 70/409
6,983,630 B2 * 1/2006 Eden et al. ..... 70/493
7,159,424 B2 * 1/2007 Widen ..... 70/409
7,207,200 B2 * 4/2007 Eden et al. ..... 70/358
7,337,639 B2 * 3/2008 Edwards, Jr. ..... 70/409
7,370,502 B2 * 5/2008 Widen ..... 70/493
7,487,653 B2 * 2/2009 Widen ..... 70/409
7,621,163 B2 * 11/2009 Widen ..... 70/493
7,665,336 B2 * 2/2010 Widen ..... 70/409
7,665,337 B1 * 2/2010 Widen ..... 70/409

FOREIGN PATENT DOCUMENTS

EP 237172 A2 * 9/1987

* cited by examiner

*Primary Examiner* — Carlos Lugo
*Assistant Examiner* — Alyson M Merlino
(74) *Attorney, Agent, or Firm* — Birch, Stewart, Kolasch & Birch, LLP

(57) ABSTRACT

A profiled key for use in an associated cylinder lock provided with a rotatable key plug having a longitudinal keyway. The key has a substantially flat key blade with a longitudinally extending profile groove at a side surface thereof and at least one local recess adjacent to the profile groove. The local recess constitutes a locally expanded portion of the profile groove, and the locally expanded portion of the profile groove has a cross-section with two opposite, non-symmetrical side walls. The local recess will accommodate a blocking element in the lock, and permit full insertion of the key blade into the keyway.

9 Claims, 4 Drawing Sheets

PROFILE KEY WITH LOCAL RECESS

FIELD AND BACKGROUND OF THE INVENTION

The present invention relates to a key for use in an associated cylinder provided with a rotatable key plug having a longitudinal keyway. The key blade has a substantially flat key blade and a longitudinally extending profile groove. The key is especially adapted for use in a lock having a blocking element, which is movable elevationally so as to prevent the insertion of an incorrectly cut key blade into the keyway.

The key of the present invention is part of an inventive concept of a lock and key combination, which is the subject of a separate patent application being filed in parallel with the present application.

The contents of the parallel application mentioned above is incorporated in this disclosure by reference.

Similar lock and key combinations are generally known, e.g. from the U.S. Pat. No. 5,715,717 (Widén). The profile groove or grooves in the key will provide great possibilities to vary the cross-sectional profile of the key, which is a great advantage.

OBJECT OF THE INVENTION

The object of the present invention is to provide a key, cooperating with a blocking mechanism in the lock and providing an increased number of profile varieties.

SUMMARY OF THE INVENTION

According to an embodiment of the present invention, a key is provided in combination with a blocking element and a profile rib for use in an associated cylinder lock provided with a rotatable key plug having a longitudinal key way with a profile rib extending along the key way, said profile rib being provided with at least one longitudinally confined cut-out portion accommodating said blocking element and each said blocking element forming a movable portion of said profile rib, said blocking element having a vertical dimension that is larger than a cross-section of said profile rib, said key having a substantially flat key blade, wherein:

said substantially flat key blade has a longitudinally extending profile groove at at least one side surface thereof, said profile groove is provided with an inner, longitudinally straight portion extending along the substantially flat key blade and corresponding to an outermost portion of the profile rib in said longitudinal key way of the key plug, said profile groove also being provided with an outer portion having a first or lower side wall with a ramp surface leading from a first or bottom edge of the key blade to the first or lower side wall and a second or upper side wall located opposite to said first or lower side wall, said substantially flat key blade also has at least one local recess in said second or upper side wall adjacent to said profile groove, said at least one local recess constitutes a locally expanded and longitudinally confined portion of said profile groove, and said locally expanded and longitudinally confined portion of the profile groove forming the at least one local recess having a cross-section with two opposite, non-symmetrical and non-parallel side walls extending in the longitudinal direction of the key blade;

wherein a vertical dimension of said outer portion of said profile groove between said first or lower side wall and said second or upper side wall, is smaller than the vertical dimension of the blocking element, except for the locally expanded and longitudinally confined portion forming said at least one local recess, where a vertical dimension of said outer portion at said locally expanded and longitudinally confined portion of said profile groove is larger than the vertical dimension of said blocking element, said vertical dimension of said outer portion at said locally expanded and longitudinally confined portion extending between said non-symmetrical and non-parallel opposite side walls thereof;

said opposite side walls of said locally expanded and longitudinally confined portion being adapted in shape so as to accommodate non-symmetrical and non-parallel upper and lower portions of said blocking element; and said profile groove, with its at least one local recess, being configured to enable said blocking element to perform an elevational movement and to be accommodated in said locally expanded and longitudinally confined portion forming said at least one local recess of said profile groove, when said key blade is being inserted into said key way of the key plug and the blocking element is being moved elevationally in said cut-out portion of said profile rib of the key plug, and wherein one of said non-symmetrical and non-parallel upper and lower portions of said blocking element is concealed in an associated cut-out portion of said profile rib before said key blade is being inserted into said key way.

The key may be configured in various ways, in accordance with the dependent claims and as explained further below with reference to the appended drawings.

SHORT DESCRIPTION OF THE DRAWINGS

FIG. 1*a* shows, in a side view, a cylinder lock, with a key blade inserted therein;

FIG. 1*b* shows the cylinder lock and key combination of FIG. 1*a* in a perspective view;

FIG. 1*c* shows the lock and key combination of FIG. 1*a* in a perspective, exploded view, illustrating a locking mechanism above the keyway of the lock and the key blade according to the invention;

FIG. 1*d* shows a cross-section along the line Id-Id in FIG. 1*a* also illustrating a blocking element arranged in the key plug of the lock;

FIG. 1*e* shows a cross-section as in FIG. 1*d*, but without a key;

FIG. 1*f* shows a cross-section along the line 1*f*-1*f* in FIG. 1*a;*

FIGS. 2*a*, 2*b* show schematically in perspective views how the key blade interacts with the blocking element of the lock (FIG. 2*b* at a larger scale);

FIGS. 3*a* and 3*b* show the key blade of FIGS. 2*a*, 2*b* in a side view (FIG. 2*b* at a larger scale);

DETAILED DESCRIPTION OF PREFERRED EMBODIMENTS

In FIGS. 1*a*, 1*b*, 1*c*, 1*d*, 1*e*, 1*f* there is shown a cylinder lock and key combination having conventional upper and lower tumbler pins 1, 2 in a linear row (FIG. 1*c*) cooperating with an upper edge of the inserted key blade, the upper edge having a corresponding number of recess cuts 11, 12, 13, 14, 15, 16 at various levels. Deep inside the keyway of the lock, not very far from the tip of the inserted key blade, there is a blocking element 20, which is movable elevationally (up and down) at the side of the keyway.

Figure 1A:
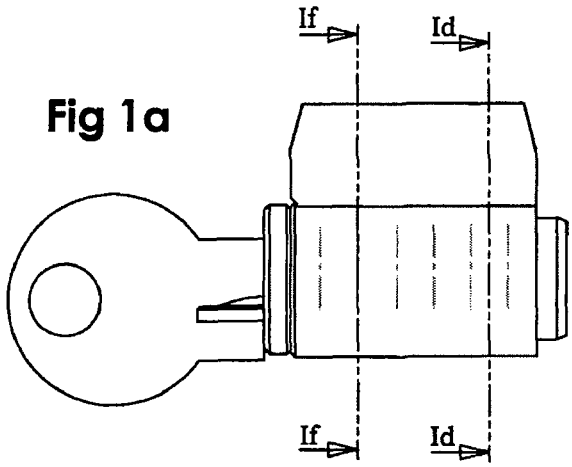
Figure 1B:
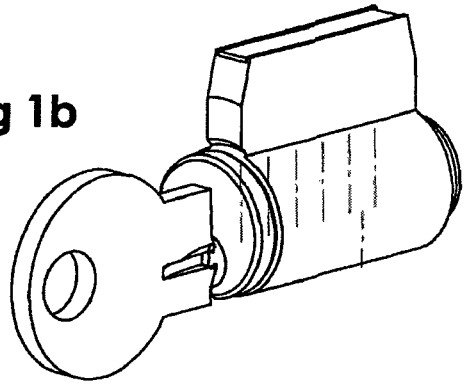
Figure 1C:
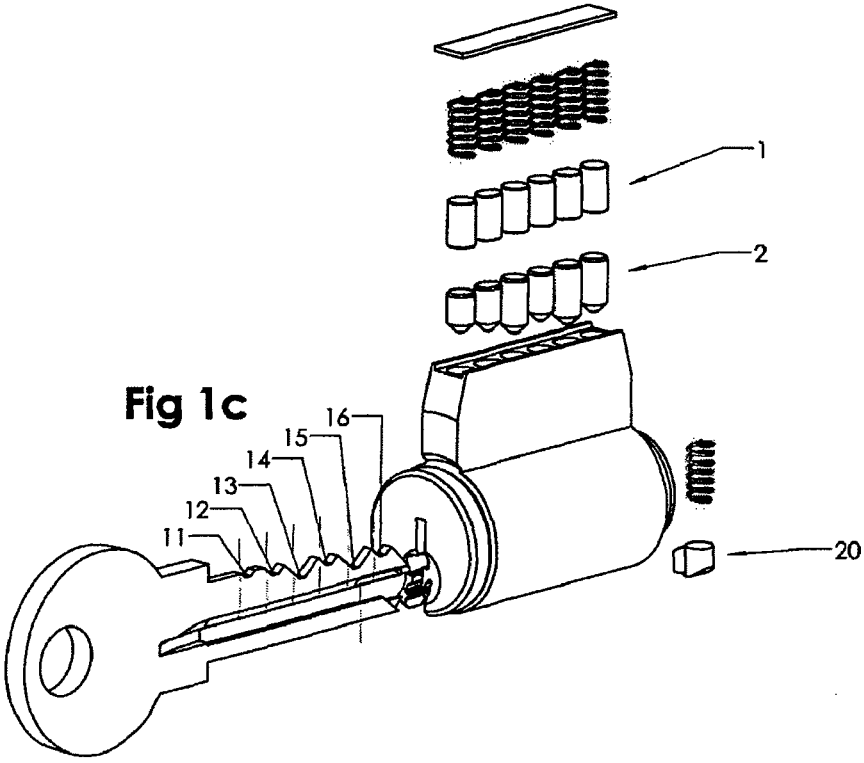
Figure 1D:
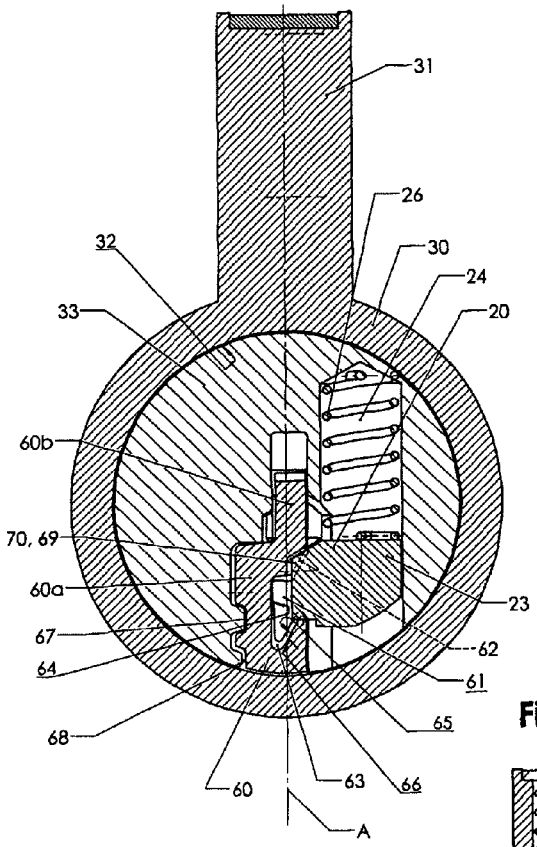

The blocking element, and its interaction with the inserted key blade, will be better understood from FIG. 1*d*. Here, the cylindrical housing of the lock is denoted 30, having an upright housing part 31 accommodating the upper locking pins 1, 2 mentioned above and a cylindrical bore 32, in which a cylindrical key plug 33 is rotatably journalled.

Figure 1E:
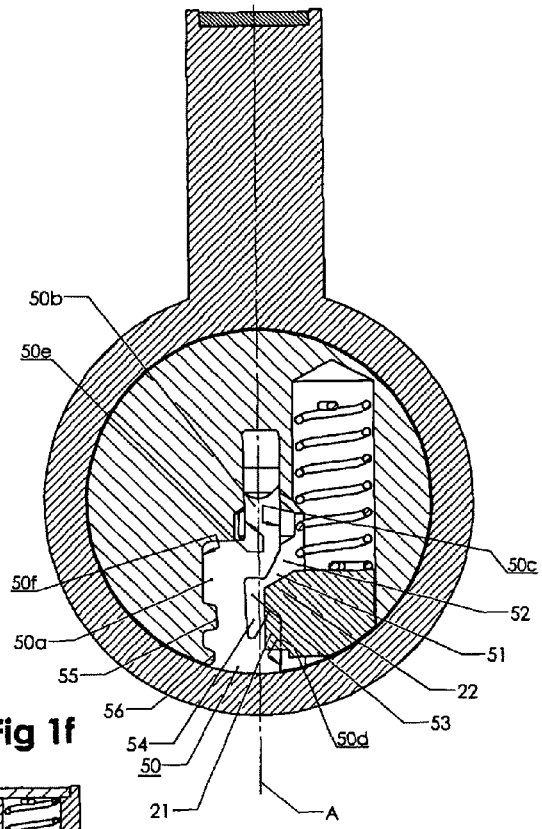
Figure 3A:
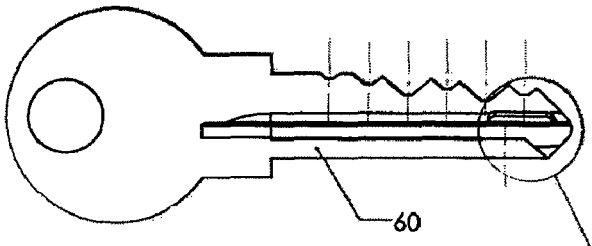
Figure 3B:
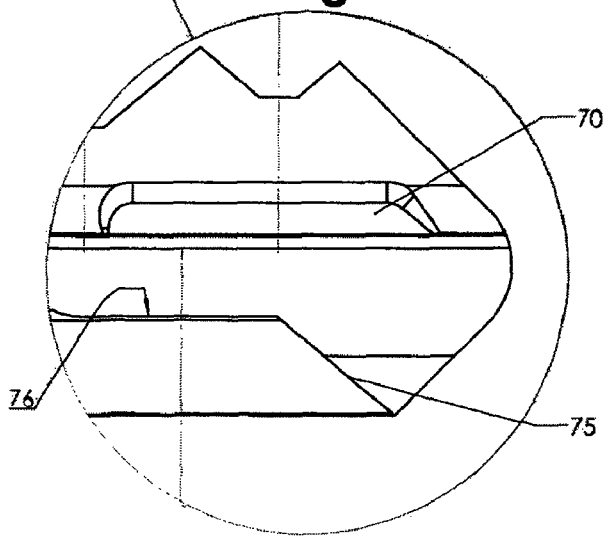

The key plug 33 has a central keyway 50 extending longitudinally along the axis of the cylindrical bore 32 and a central plane A extending through the cylindrical axis and the upper housing portion 31. In a longitudinal row in this plane A, there are a number of cylindrical holes (not visible in FIG. 1*d*) each accommodating one of the lower locking pins 2. In FIGS. 1*d* and 1*e*, the profile of the keyway 50 and the corresponding key blade 60 are clearly visible. The keyway 50 is oriented along the central plane A. It has a lower, rather wide portion 50*a*, and an upper, relatively narrow portion 50*b*. The upper and lower portions of the keyway have side walls 50*c* and 50*d* lying in a common plane in parallel to the central plane A (to the right thereof in FIG. 3). At the other lateral side, the upper keyway portion 50*b* has a side wall 50*e*, whereas the lower part of the keyway has a side wall 50*f*, the latter being located further away from the central plane A than the upper side wall 50*e*.

On the right hand side of the keyway, there is a longitudinal, profiled rib 51 extending along the key plug. The profile rib 51 has a base portion 52 (concealed by the blocking element 20 in FIG. 1*d*) and an end portion 53 provided with a downwardly directed tongue 54.

On the left hand side, the keyway has two longitudinal ribs 55 and 56 at the lower portion of the keyway.

The key blade 60 (see FIG. 1*d*), according to the present invention, has a profile shape which is substantially supplementary to the keyway 50. Accordingly, the key 60 has a lower base portion 60*a*, which is relatively wide, and an upper portion 60*b*, which is relatively narrow.

At the right hand side (as seen in FIG. 1*d*) the key blade has a longitudinally extending groove 61 with an outer portion 62, and an inner, undercut portion 63. The profile groove 60 has a bottom wall 64 and an opposite side wall 65, which is inclined and faces the bottom wall 64 and also forms the inside wall of a ridge 66 extending along the key blade 60.

As will be evident from FIG. 1*d*, the profile groove 61 accommodates the longitudinally extending profile rib 51, including the downwardly directed tongue 54 in the undercut portion of the groove 61.

On the left hand side, the key blade 60 has two longitudinal grooves 67 and 68 corresponding to the profile ribs 55, 54.

Figure 1F:
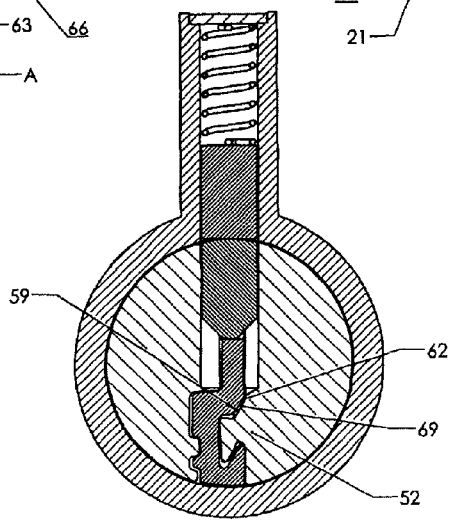

As appears from FIG. 1*f*, the outer portion 62 of the profile groove 61, and the corresponding base portion 52 of the profile rib 50 has a slanted upper wall 69 and slanted surface 59, respectively.

Now, since the sectional profile of the key blade 60 corresponds to the cross-sectional profile of the keyway 50, the key blade 60 can be inserted partially or fully into the keyway, as is known in the art. Of course, only key blades being cut with the particular profile of the keyway may be fully inserted into the keyway.

In order to allow for further variations of the exact profile of the keyway, there is provided, according to the present invention, a blocking element 20 (as mentioned above) which can be regarded as a movable profile portion.

Generally, the blocking element has a profile section, which corresponds to the longitudinally extending groove 61 in the key blade. However, in the region of the outer portion 62 of the groove 61, it is somewhat larger, in a direction parallel to the central plane A. So, it does not fit into the profile groove of the keyway along the full length thereof.

However, according to the present invention, the key blade 60 is provided with a local recess 70 which constitutes a locally expanded portion of the profile groove 62 and is wide enough to accommodate the uppermost portion of the blocking element 20, as will be explained more fully below.

In order to secure a well-defined mobility of the blocking element 20, it is integrated with or firmly connected to a body 23, which is guided for elevational movement in parallel to the central plane A of the key way in a substantially cylindrical cavity 24 at the side of the keyway, in parallel to the central plane A. Thus, the body 23 is guided for movement up and down in the cylindrical cavity 24, so that the integrated or connected blocking element 20 is also movable up and down.

The blocking element 20 may protrude partially or fully into the profile groove 61, in a cut-out portion of the profile rib 51.

Figure 2A:
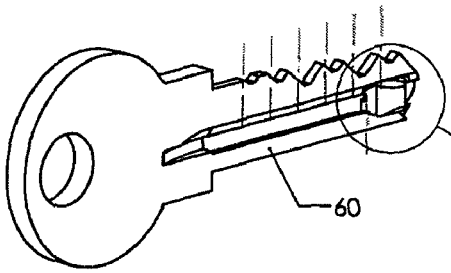
Figure 2B:
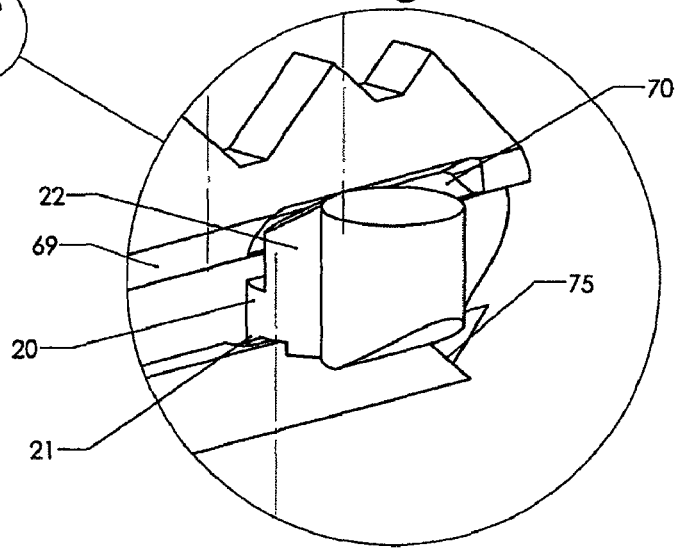

The interaction between the blocking element and the key blade is illustrated in FIGS. 2*a*, 2*b*, 3*a*, 3*b*. Initially, when the keyway 50 is empty (see FIG. 1*e*), the blocking element 20 will be positioned in its lowermost position, because of the action of a compression spring 26 in the cavity 24 (FIG. 1*d*). In the embodiment of FIGS. 2*a*, 2*b*, 2*a*, 2*b*, the profile groove 61 of the key blade 60 has no undercut portion, but this will not make any difference to the interaction between the key blade and the blocking element 20.

When the key blade 60 is inserted into the keyway 50, a lower, first portion 21 of the blocking element 20 will make contact with a ramp surface 75 near the tip end of the key blade. By way of this contact, the blocking element 20 will move upwards and take the position shown in FIGS. 1*d* and 2*b*. Here, the upper, second portion 22 of the blocking element 20 will be accommodated in the above-mentioned recess 70, which is locally cut out in this particular part of the keyway, so the width of the profile groove is effectively widened in this region.

Without such a recess 70, the blocking element would be jammed between the ramp surface 75 and the upper, slanted wall 69 of the longitudinal profile groove.

Figure 6:
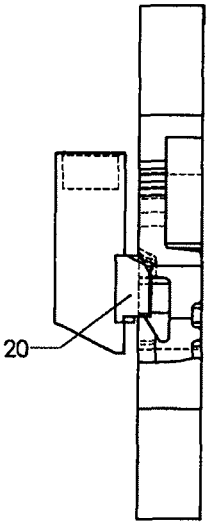
FIGS. 5 and 6 show the blocking element and the key blade of FIG. 4 in a cross-sectional view and an end view, respectively.
Figure 4:
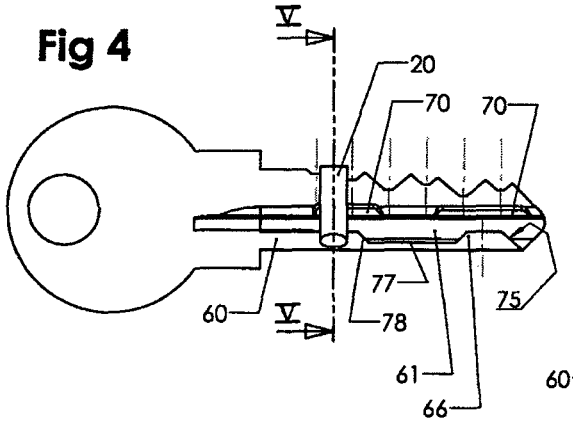
FIG. 4 shows, in a side view, a key blade anid a blocking element located closer to the entrance of the keyway.
Figure 5:
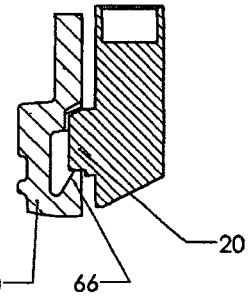

In the embodiment shown in FIGS. 2*a* and 2*b*, the blocking pin 20 is located deep inside the keyway near the tip end of the key blade upon full insertion of the key blade into the keyway. The first or lower projecting portion 21 of the blocking element 20 contacts a machined, slightly recessed surface 76 (FIG. 3*b*) adjacent to the lower side wall of the profile groove (in this embodiment there is no undercut portion), whereas the upper or second projecting portion 22 of the blocking element 20 is accommodated in the local recess 70. This recess 70 is confined to the region of the fully inserted key blade in the vicinity of the blocking element 20. In FIGS. 4, 5, 6, the blocking element 20 is located closer to the entrance of the keyway, so when the key blade is fully inserted into the keyway, the blocking element 20 is far away from the tip end of key blade. In order to accommodate the whole cross-section of the blocking element 20, the lower part of the key blade material next to the groove 61 is taken away. Thus, the ridge portion 66 is cut away from the tip end of the key blade up to the location of the blocking element, leaving a lower side wall 77, except for a portion near the tip end of the key blade. In this case, of course, the local upper recess, accommodating the second or upper projecting portion 22 of the blocking element 20 is located so as to start, with some overlap, where the lower side wall 77 and an adjoining inclined or ramp surface 78 ends. The overlap length should correspond or slightly exceed the dimension of the blocking element 20 in the longitudinal direction of the key plug.

The upper, slanted wall portion of the recess 70 has an angle corresponding to the second projecting portion 22 of the blocking element 20.

As will be seen from FIG. 4, the key blade is provided with a second local recess 70 near the tip end, just like the key blade shown in FIGS. 2*a* and 2*b*. Therefore, the key blade of FIG. 4 will cooperate also with a blocking element 20 arranged deep inside the keyway, like the one shown in FIG. 2*b*.

Accordingly, by having two or more blocking elements distributed longitudinally along the keyway, it is possible to provide a hierarchic system with master keys that open all individual locks having blocking pins at various locations.

The blocking element in the lock may be urged to move up and down only by interaction with the profile groove and its adjoining recesses above and below the groove, without any spring acting on the body in the side cavity. Thus, the blocking element will then be positively guided by the upper and lower side walls of the partially expanded profile groove.

The invention claimed is:

1. A key in combination with at least one blocking element for use in an associated cylinder lock provided with a rotatable key plug having a longitudinal key way with a profile rib extending along the key way, said profile rib being provided with at least one longitudinally confined cut-out portion accommodating said at least one blocking element and said at least one blocking element forming a movable portion of said profile rib, said at least one blocking element having a vertical dimension that is larger than a cross-section of said profile rib, said key having a substantially flat key blade, wherein:

said substantially flat key blade has a longitudinally extending profile groove at at least one side surface thereof, said profile groove is provided with an inner, longitudinally straight portion extending along the substantially flat key blade and corresponding to an outermost portion of the profile rib in said longitudinal key way of the key plug, said profile groove also being provided with an outer portion having a first or lower side wall with a ramp surface leading from a first or bottom edge of the key blade to the first or lower side wall and a second or upper side wall located opposite to said first or lower side wall, said substantially flat key blade also has at least one local recess in said second or upper side wall of said profile groove, said at least one local recess constitutes a locally expanded and longitudinally confined portion of said profile groove, and said locally expanded and longitudinally confined portion of the profile groove forming the at least one local recess having a cross-section with two opposite, non-symmetrical and non-parallel side walls extending in the longitudinal direction of the key blade;

wherein a vertical dimension of said outer portion of said profile groove between said first or lower side wall and said second or upper side wall, is smaller than the vertical dimension of the at least one blocking element, except for the locally expanded and longitudinally confined portion forming said at least one local recess, where a vertical dimension of said outer portion at said locally expanded and longitudinally confined portion of said profile groove is larger than the vertical dimension of said at least one blocking element, said vertical dimension of said outer portion at said locally expanded and longitudinally confined portion extending between said non-symmetrical and non-parallel opposite side walls thereof;

said opposite side walls of said locally expanded and longitudinally confined portion being adapted in shape so as to accommodate non-symmetrical and non-parallel upper and lower portions of said at least one blocking element; and said profile groove, with said at least one local recess, being configured to enable said at least one blocking element to perform an elevational movement and to be accommodated in said locally expanded and longitudinally confined portion forming said at least one local recess of said profile groove, when said key blade is being inserted into said key way of the key plug and the at least one blocking element is being moved elevationally in said cut-out portion of said profile rib of the key plug, and wherein one of said non-symmetrical and non-parallel upper and lower portions of said at least one blocking element is concealed in an associated cut-out portion of said profile rib before said key blade is being inserted into said key way.

2. A key as defined in claim 1, wherein said inner, straight portion of said profile groove of the key blade has a substantially rectangular cross-section.

3. A key as defined in claim 1, wherein said first or lower side wall of said profile groove of the key blade has an undercut part.

4. A key as defined in claim 1, wherein said profile groove in the side surface of said key blade has an outer, longitudinally straight portion extending along at least a part of the length of said inner, straight portion and merging with the latter, said outer, longitudinally straight portion of the groove having an upper wall being slanted and facing away from the key blade.

5. A key as defined in claim 4, wherein said two opposite, non-symmetrical and non-parallel side walls of said locally expanded and longitudinally confined portion comprises a first or lower wall portion, oriented substantially perpendicularly to said at least one side surface of the key blade, and a second or upper, slanted wall portion being inclined so as to face outwardly from the at least one side surface of the key blade.

6. A key as defined in claim 1, wherein said locally expanded and longitudinally confined portion of the profile groove has a longitudinally adjoining opposite recess at an opposite side wall of the profile groove, said longitudinally adjoining opposite recess being located opposite to said at least one local recess and, in the longitudinal direction, closer to the tip end of the key blade.

7. A key as defined in claim 6, wherein said longitudinally adjoining opposite recess is a recess in said opposite side wall and has a longitudinally straight surface extending in parallel to said profile groove.

8. A key as defined in claim 6, wherein there is a longitudinal overlap between said locally expanded profile groove portion and said longitudinally adjoining opposite recess.

9. A key in combination with at least one blocking element for use in an associated cylinder lock provided with a rotatable key plug having a longitudinal key way, said key having a substantially flat key blade, comprising:

a longitudinally extending profile groove at at least one side surface of said substantially flat key blade, said longitudinally extending profile groove is also provided with an outer portion having a first or lower side wall with a ramp surface leading from a bottom edge of the key blade to the first or lower side wall and a second or upper side wall located opposite to said first or lower side wall;

said profile groove is provided with an inner, longitudinally straight portion extending along the substantially flat key blade and corresponding to an outermost portion of a profile rib in said longitudinal key way of the key plug;

at least two local recesses in said second or upper side wall formed in said profile groove in said substantially flat key blade;

said at least two local recesses constitute two locally expanded and longitudinally confined portions of said profile groove, said locally expanded and longitudinally confined portions of the profile groove forming the at least two local recesses having a cross-section with two opposite, non-symmetrical and non-parallel side walls extending in the longitudinal direction of the key blade, and a longitudinally adjoining opposite recess at the first or lower side wall, said longitudinally adjoining opposite recess being located between said at least two local recesses;

wherein a vertical dimension of said outer portion of said profile groove between said first or lower side wall and said second or upper side wall, is smaller than a vertical dimension of the at least one blocking element, except for the locally expanded and longitudinally confined portions forming said at least two local recesses, where a vertical dimension of said outer portion at said locally expanded and longitudinally confined portions is larger than the vertical dimension of said at least one blocking element, said vertical dimension of the locally expanded and longitudinally confined portions extending between non-symmetrical and non-parallel opposite side walls thereof;

said opposite side walls of said locally expanded and longitudinally confined portions being adapted in shape so as to accommodate non-symmetrical and non-parallel upper and lower portions of said at least one blocking element; and said profile groove, with its at least two local recesses, being configured to enable said at least one blocking element to perform an elevational movement and to be accommodated in said locally expanded and longitudinally confined portions forming said at least two local recesses of said profile groove, when said key blade is being inserted into said key way of the key plug.

* * * * *